United States Patent [19]

Fetterolf, Sr. et al.

[11] 4,310,213

[45] Jan. 12, 1982

[54] ELECTRICAL CONNECTOR KIT

[75] Inventors: James R. Fetterolf, Sr., Burnsville, Minn.; Donald L. Metzger, Harrisburg, Pa.; Clair W. Snyder, Jr., Hellam, Pa.; James H. Wise, Harrisburg, Pa.

[73] Assignee: AMP Incorporated, Harrisburg, Pa.

[21] Appl. No.: 52,991

[22] Filed: Jun. 28, 1979

Related U.S. Application Data

[63] Continuation of Ser. No. 893,744, Apr. 5, 1978, abandoned.

[51] Int. Cl.[3] ..... H01R 13/58

[52] U.S. Cl. ..... 339/103 M

[58] Field of Search ..... 339/89, 90, 101, 103, 339/176 R, 176 M, 252 R

[56] References Cited

U.S. PATENT DOCUMENTS

| | | | |
|---|---|---|---|
| 3,032,741 | 5/1962 | Fitzgerald | 339/252 R |
| 3,149,893 | 9/1964 | Dupre | 339/176 MP |
| 3,178,673 | 4/1965 | Krehbiel | 339/252 R |
| 3,402,382 | 9/1968 | De Tar | 339/103 |
| 3,437,980 | 4/1969 | Smith | 339/103 R |
| 3,533,053 | 10/1970 | Sosinski | 339/198 P |
| 3,588,783 | 6/1971 | Newman | 339/59 |
| 3,611,273 | 10/1971 | Alibert | 339/89 M |
| 3,649,956 | 3/1972 | Vrobel | 339/89 M |
| 3,721,939 | 3/1973 | Paugh | 339/101 |
| 3,763,460 | 10/1973 | Hatschek | 339/89 M |
| 3,861,778 | 1/1975 | Capra | 339/103 R |
| 3,885,849 | 5/1975 | Bailey et al. | 339/31 R |
| 3,901,574 | 8/1975 | Paullus et al. | 339/90 R |
| 3,947,080 | 3/1976 | Ege | 339/258 S |
| 3,986,765 | 10/1976 | Shaffer et al. | 339/103 R |
| 4,106,834 | 8/1978 | Horowitz | 339/44 M |

FOREIGN PATENT DOCUMENTS

| | | | |
|---|---|---|---|
| 494723 | 7/1953 | Canada | 339/103 R |
| 2245032 | 3/1974 | Fed. Rep. of Germany | 339/176 M |
| 2514686 | 10/1975 | Fed. Rep. of Germany | 339/252 R |

*Primary Examiner*—Joseph H. McGlynn

*Attorney, Agent, or Firm*—Frederick W. Raring; Adrian J. LaRue

[57] ABSTRACT

A kit for an electrical connector is disclosed for use in connecting a first electrical device to a second electrical device; for example, connecting an audio microphone to a CB radio. The kit includes a cable guard member receiving therethrough a cable from the first device; first and second terminal members, with the first terminal members connected to conductors of the cable; and a connector housing having cavities extending therethrough to receive the second terminal members. The second terminal members are loaded into the cavities and the first terminal members subsequently inserted therein in mating engagement with the second terminal members. When the connector housing and cable guard member are connected together and the housing plugged into a socket mounted in the second electrical device, electical connection is established between the first and second devices. The kit further includes cable strain relief means and coupling means to secure the connector to a mating connector.

11 Claims, 11 Drawing Figures

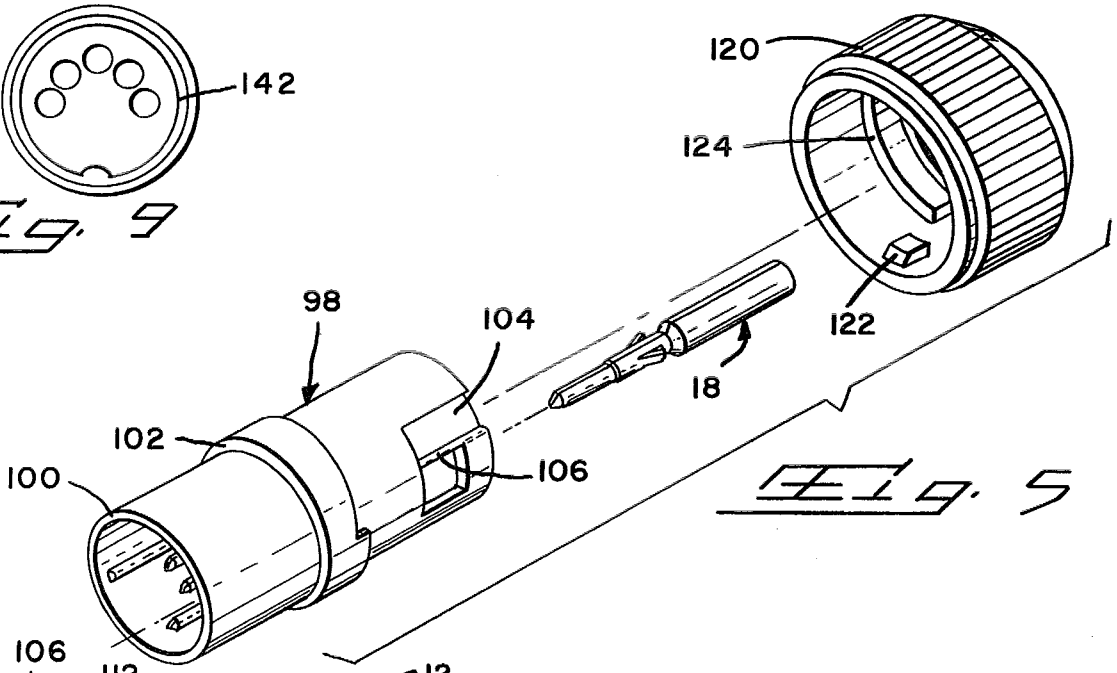
FIG. 5
FIG. 9
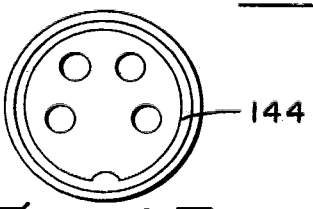
FIG. 10
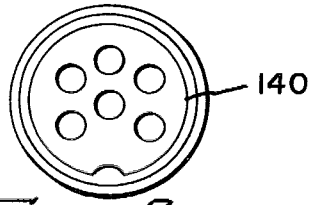
FIG. 8
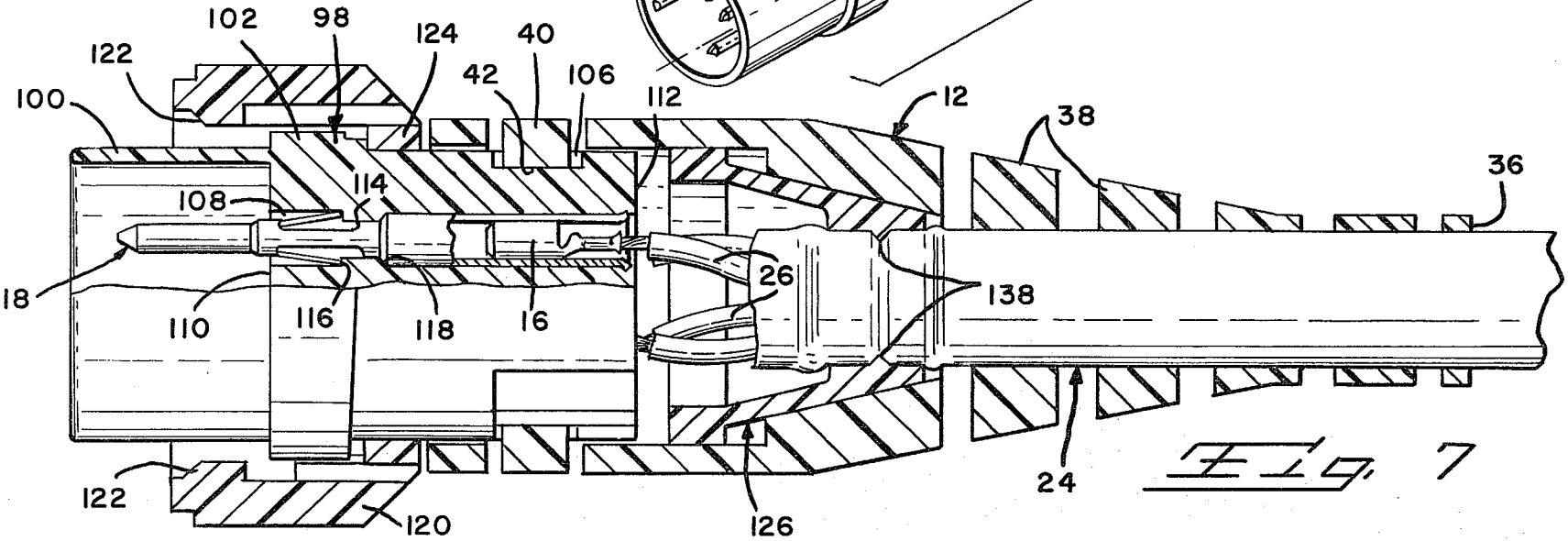
FIG. 7

ELECTRICAL CONNECTOR KIT

This is a continuation, of application Ser. No. 893,744, filed Apr. 5, 1978, now abandoned.

BACKGROUND OF THE INVENTION

1. The Field of the Invention

This invention relates to a kit for an electrical connector to be used in connecting wire leads from a second electrical device to socket means in a first electrically operated device, such as an audio microphone to a citizen band radio or the like.

2. The Prior Art

Manufacturers of a wide variety of electrical devices commonly design and market their products to be used conjuctively with other electrical devices. For example, citizen band radio manufacturers design their radios to use a remote control device such as a microphone assembly which can be electrically connected to the radio unit by the purchaser. The manufacturer of the remote control device correspondingly designs his assembly, and more specifically the connector for the assembly, to be matable with as many of the different CB radios manufactured as possible so as to broaden the appeal for his product. Moreover, it is desirable that the microphone or remote control device assembly have utility with more than one type of device and that the assembly connector facilitate all such uses of the assembly. The problem, however, is that all CB radios, tape recorders, and the like do not have a standardized socket receptacle configuration with which to receive a standardized connector/microphone assembly. Consequently, manufacturers of these assemblies have long felt the need for an inexpensive connector which could be made compatible with the variety of socket configurations presented by the different electrical devices; a connector versatile enough to interchangeably facilitate electrical connection between a single electrical assembly, such as a remote control device, and a plurality of electrical products.

Heretofore, no connector could adhere to the cost, compatibility, and versatility restraints hereinabove outlined. U.S. Pat. No. 3,986,765 discloses and claims a connector for connecting an electrical power cord to an electrically operated device. This connector works well and has received a favorable reception from the industry; however, the connector lacks versatility in engaging a wide variety of socket configurations presented by different electrical products. Another limitation of this connector is that it is not assembled by the customer, but rather must be preassembled by the manufacturer which adds greatly to its cost.

SUMMARY OF THE INVENTION

The instant invention is directed toward the achievement of an inexpensive electrical connector which is assembled from a kit by the purchaser and which can be adaptably mated to a wide variety of socket configurations within electrical devices. The kit includes a cable guard member having a bore therethrough through which a multiconductor cable is extended. Conductors of the cable have first terminal members affixed to the free ends thereof. A connector housing is further provided having a plurality of terminal receiving cavities extending therethrough to receive a like plurality of second terminal members therein. The first terminal members are inserted into the cavities in mating engagement with the second terminal members which have been preinserted therein. The connector housing is selected by the user so that the terminal configuration presented by the cavities corresponds to the configuration of the socket in the electrical device, whereby upon connecting the cable guard to the connector housing and the connector housing to the socket, the microphone or remote control device assembly is electrically connected to the radio. The connector housing is selected to match the socket configuration of the electrical device and the customer can stock a number of connector housings, each having a different cavity configuration, and by interchanging these connector housings use one microphone assembly with a variety of electrical devices. The kit further includes cable strain relief means and coupling means to secure the connector assembly to the mating connector member.

Accordingly, it is an object of the instant invention to provide a connector which is relatively inexpensive to produce and which is adaptably compatible with the socket configurations presented by various electrical devices.

Another object of the present invention is to provide a connector which is assembled from a kit in a series of simplistic steps which can be performed by the purchaser thereof.

Still another object of the instant invention is to provide a connector which can be easily disassembled and modified into a different plug configuration.

A further object of the instant invention is to provide a connector which can withstand repeated matings to a socket and still maintain positive electrical contact therewith.

A still further object of the present invention is to produce an improved electrical connector kit which can be readily and economically manufactured.

These and other objects of the instant invention will become apparent to those skilled in the art from the following detailed description taken with reference to the accompanying drawings.

BRIEF DESCRIPTION OF THE DRAWINGS

FIG. 5 is an exploded perspective view of alternative embodiments of elements of the subject kit;

FIGS. 8, 9 and 10 are mating end elevations of connector housings showing representative different cavity and terminal configurations; and FIG. 11 is a perspective view showing commoning of two first terminals of the subject invention.

DETAILED DESCRIPTION OF THE PREFERRED EMBODIMENT

Figure 1:
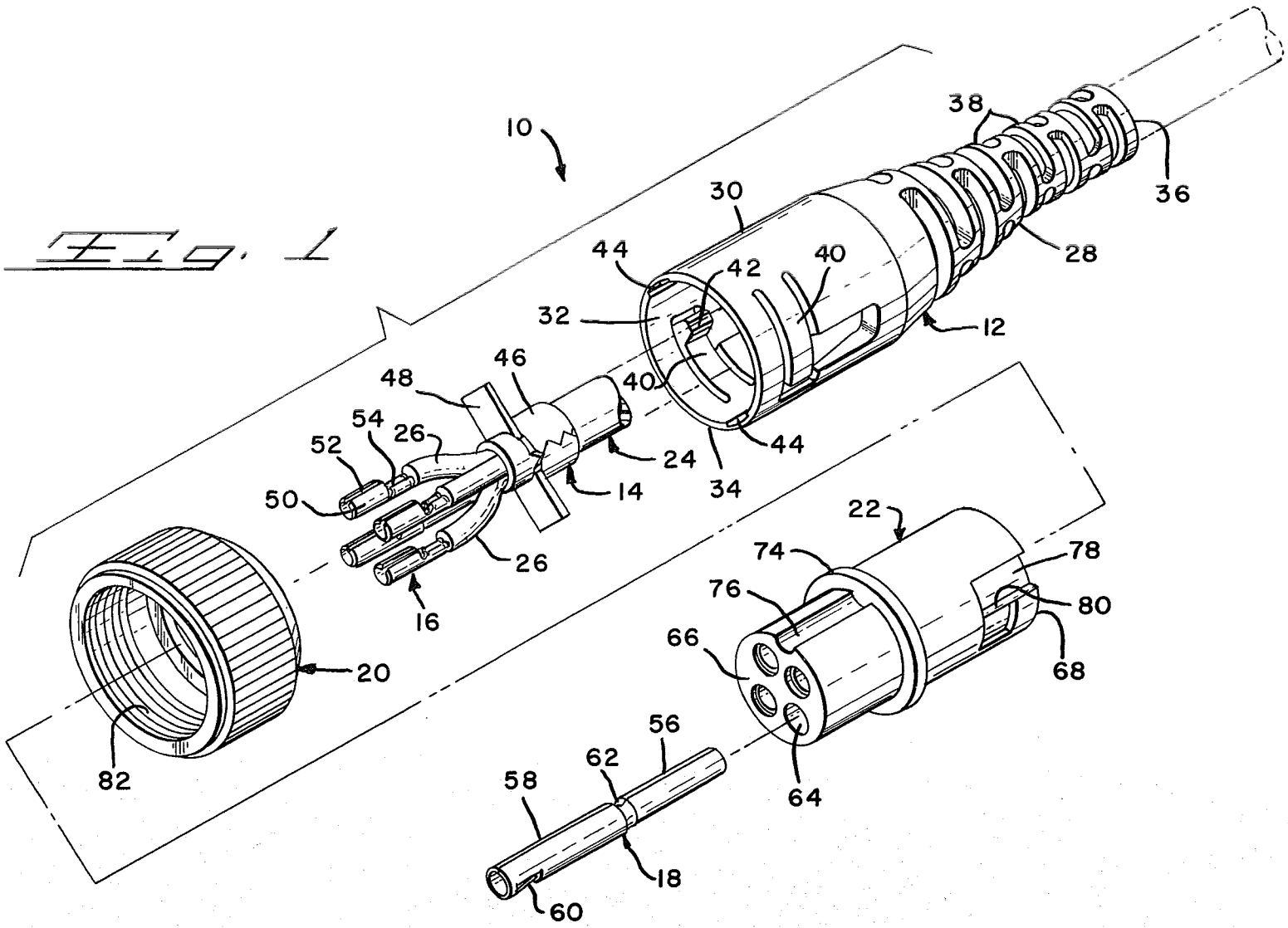
FIG. 1 is an exploded perspective view of a first embodiment of the subject connector kit.
Figure 2:
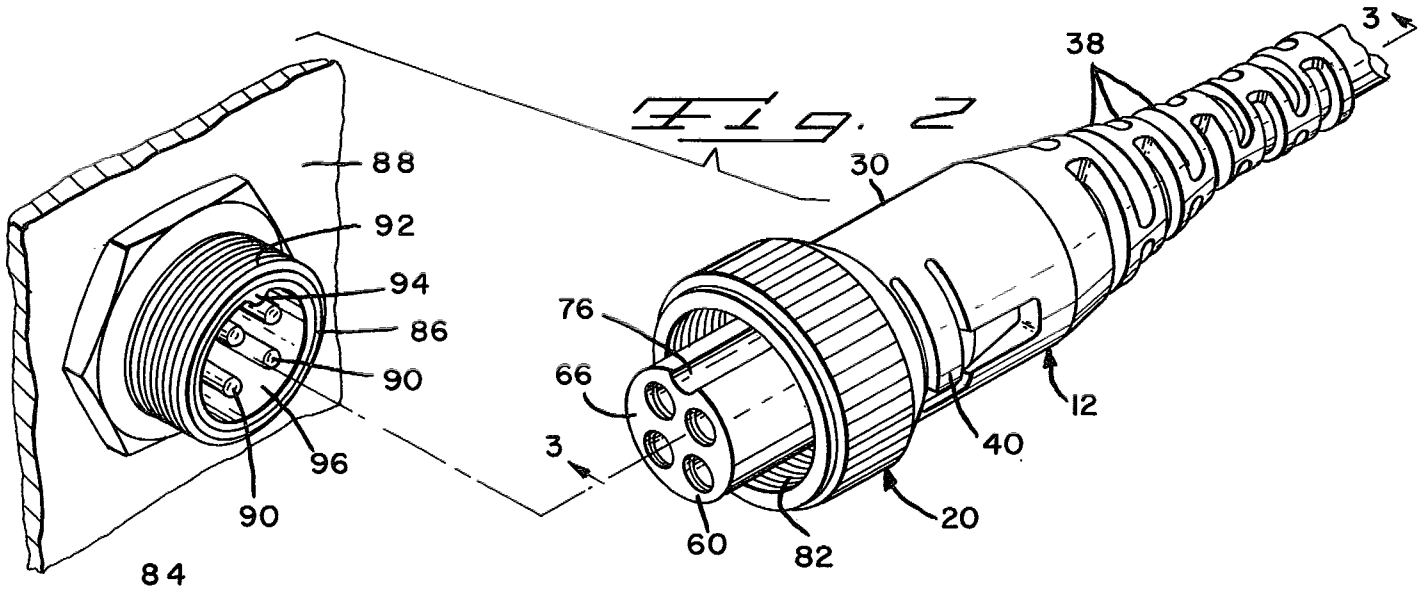
FIG. 2 is a perspective view showing the assembled conductor exploded from a socket to which it is to be mated.

Referring first to FIGS. 1 and 2, a preferred embodiment of the kit 10 is shown generally to include the cable guard member 12, a strain relief member 14, first terminal members 16, and second terminal members 18, a coupling collar 20, and a connector housing 22. The kit 10 is to be assembled on the free end of cable 24 terminating the individual conductors 26. The practice of the instant invention contemplates that the kit 10 will be supplied to a customer who will then assemble the component parts into a specific connector assembly suitable for electrically connecting two electrical devices.

With more particular reference to FIGS. 1 and 2, the kit 10 is hereinbelow described in detail. The cable guard member 12 is provided with a rearward cable gripping portion 28, a forward tubular portion 30, and an axial bore 32 extending longitudinally therethrough from a forward end 34 to a rearward end 36. The rearward portion 28 comprises a plurality of concentrically molded and connected rings 38 of decreasing diameter towards the rearward end 36 dimensioned to closely receive a cable 24 therethrough. The rings serve to resiliently reinforce the cable 24 from extreme lateral manipulations.

The forward portion 30 of the cable guard 12 has integrally molded and generally arcuate-shaped cantilever ribs 40 extending partially therearound, each rib having an inwardly directed locking projection 42 on the free end thereof. The forward portion 30 further has a pair of integral guide channels 44 longitudinally extending along an inward surface of the forward portion 30 from the forward end 34.

The strain relief 14, as shown in FIG. 1, has a body 46 and a pair of outwardly projecting guide ears 48 which are dimensioned to be receivable within the guide channels 44. The strain relief 14 is crimped to the cable 24 adjacent its free end.

Figure 4:
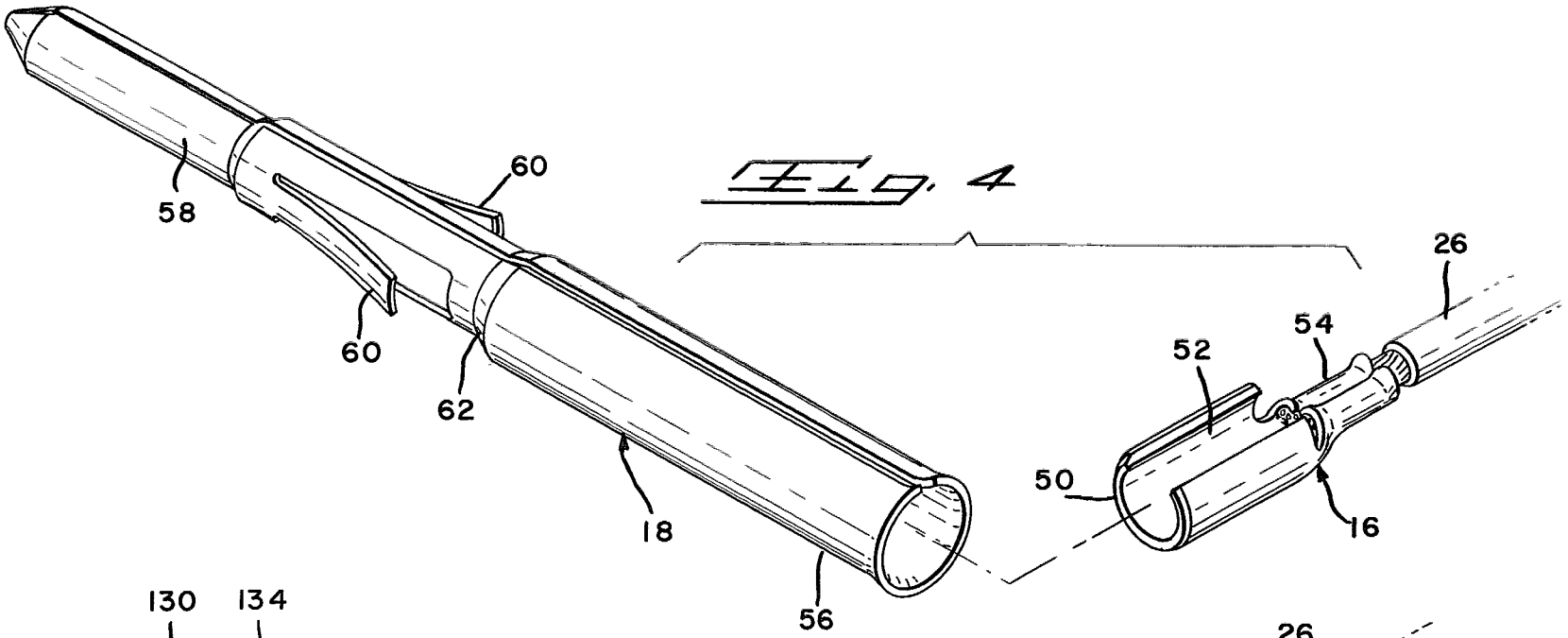
FIG. 4 is an exploded perspective view of two terminal members contained within a kit according to the present invention.

Electrically connected to the ends of the plurality of conductors 26 are a like plurality of the first terminal members 16. FIG. 1, and more particularly FIG. 4, show the first terminals 16 to have a forward cylindrical portion 50 with a longitudinal slot 52 and a rearward crimp barrel 52. The cylindrical portion 50 is stamped and formed from a conductive metal having spring-like properties which permit the cylinder to be flexed inwardly to constrict the slot 52, and decrease the cross sectional dimension of the cylinder.

The second terminal members 18 (one of which is shown) are provided with a rearward hollow cylindrical portion 56 dimensioned to receive therein, in force fit fashion, the cylindrical portions 50 of first terminals 16. Each of the second terminals 16 further has a forward mating portion 58 having a latching spring 60 formed therefrom, and an annular groove 62 between the portions 56 and 58. The mating portion 58 is shown as a female receptacle in FIG. 1 and a male plug in FIG. 4.

The connector housing 22 is provided with a plurality of profiled contact receiving cavities 64 extending from a mating force 66 to a rearward face 68. These cavities 64 are dimensioned to closely receive a respective second terminal 18 therein. Cavities 64 in housing 22 include an annular shoulder 70 which serves as a stop for terminal 18 and an enlarged rear entry 72. The end of cylinder 56 is expanded at entry 72 to secure the terminal 18 in place. The connector housing 22 further includes an outwardly directed flange 74, which is integrally molded around the housing 22 intermediate the mating face 66 and the rearward face 68, and a guide groove 76 formed in the outer surface of the housing and extending longitudinally from the mating face 66 to the flange 74. The housing 22 further has a detent groove 78 which is partitioned by an integrally molded shoulder 80. The rightward profiled configuration of the housing 22, as shown, is such that the housing is receivable within the bore 32 of the cable guard 12.

The coupling collar 20 of the kit 10 is provided with internally molded screw threads 82 and a generally annular retaining lip 84 which extends inwardly from the internal wall of the collar. The collar 20 is dimensioned so as to be mountable over the rearward face 68 of the housing 22 with lip 84 engaging flange 74.

As best seen from FIG. 2, a plug embodiment assembled from the kit 10 is designed to be matable to the socket 86 mounted on a panel 88 of a second electrical device (not shown). The socket 86 has a configured array of outwardly extending pins 90, an outer surface having screw threads 92 therearound, and a guide projection 94 extending into socket cavity 96.

Figure 3:
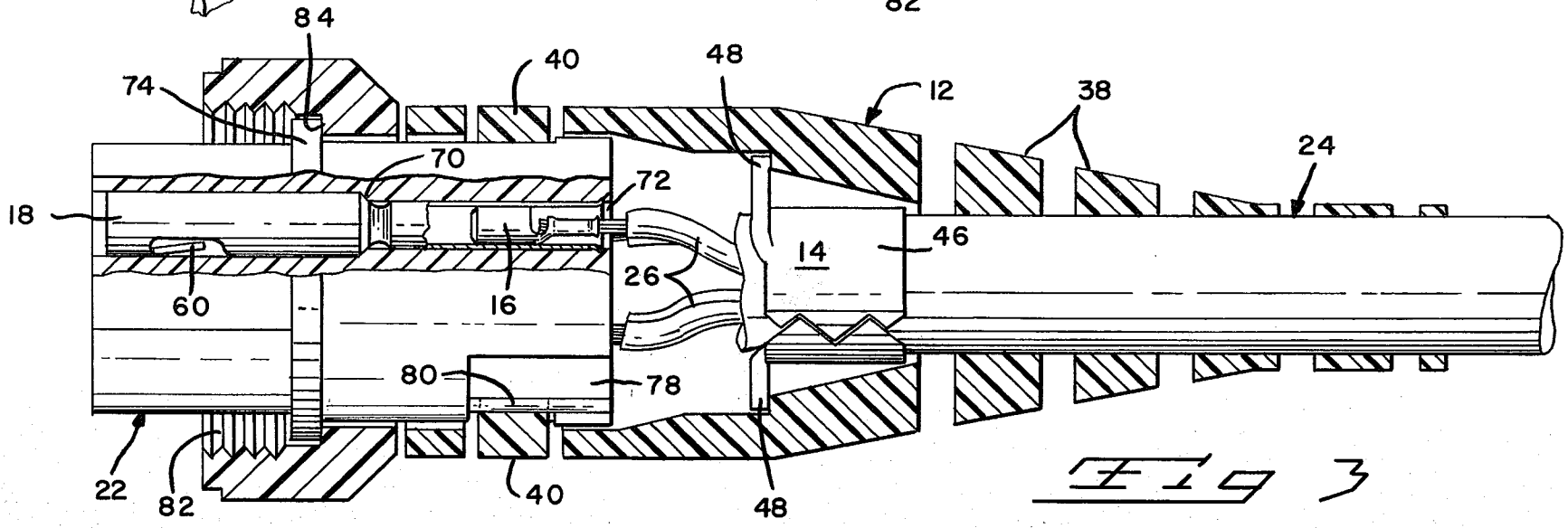
FIG. 3 is a longitudinal sectional view, taken along line 3—3 of FIG. 2, through the assembled connector according to the present invention.

With reference to FIGS. 1, 2 and 3, the assembly of the kit 10 proceeds as follows. A cable 24, which has one end connected to a first electrical device (not shown), has its free end extended through the bore 32 of the cable guard 12 in a direction from the rearward end 36 toward the forward end 34. The conductors 26, each are terminated by a respective first terminal 16 affixed to the end thereof either by a crimping or other known technique. The first terminals 16 can be crimped to the ends of the conductors by the customer, but application would best be performed by the seller of the kit who presumably has better application tooling and inspection procedures to ensure positive connections.

Proceeding with the assembly of the kit, the strain relief 14 is fixedly secured around the cable 24 adjacent the area where the conductors extend freely therefrom. The strain relief 14 is received within the forward portion 30 of the cable guard 12 when the ears 48 aligned within and motivated along the guide channels 44. The ears 48 abut the ends of channels 44, as seen in FIG. 3, to prevent the rearward removal of the cable 24 from the cable guard 12. The coupling collar 20 is slidably mounted over the rearward face 68 of the housing 22, and slid toward the mating face 66 until the lip 84 contacts the flange 74. The flange 74 prevents the forward removal of the collar. Subsequently, the second terminals 18 are inserted into the respective cavities 64 with the mating portion 58 proximate the mating face 66 of the housing. It will be noted from FIGS. 1 and 3 that the second terminals 18 are loaded into the cavities 64 from the mating face 66 of the housing 22 until grooves 62 abut annulur shoulders 72. Once fully inserted, the free ends of the cylindrical portions 56 of the second terminals 18 are outwardly flared, by appropriate tooling, to engage the sidewalls of the cavity and prevent removal of the second terminals from the cavities. The housing 22 is then axially aligned with, and positioned proximate to, the forward portion 30 of the cable guard 12, and the cylinders 50 of the first terminals 16 are inserted into the rearward portions 56 of the second terminals 18 with a force fit engagement therebetween. The connector housing 22 and the cable guard 12 are then relatively rotated until the projections 42 are aligned opposite the grooves 78. At this point, the housing 22 can be partially inserted into the forward portion 30, and further relative rotation between the housing 22 and the cable guard 12 forces the projections over the shoulders 80 to detachably lock the housing and the cable guard together. The connector assembly thus is fully assembled, as illustrated in FIG. 2. The connector can be mated to the socket 86 by aligning the projection 94 with the groove 76 and inserting the pins 90 into the mating forward portion 58 of the second terminals 18. The inwardly biased leaf spring 60 frictionally engages against the incoming pins and ensures that positive electrical and mechanical contact will be achieved between the second terminals and pins. The coupling collar 20 is rotated to engage the respective threads 82 and 90 to hold the connector assembly to the socket.

Figure 7:
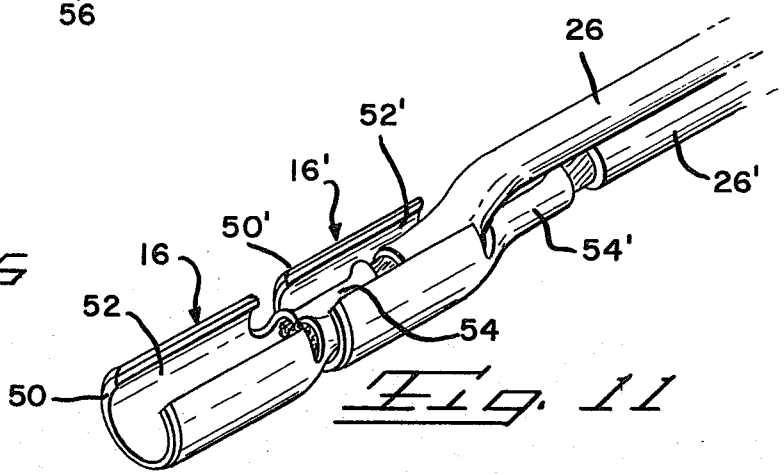
FIG. 7 is a longitudinal sectional view similar to FIG. 3 showing an assembled connector using the alternative elements of FIGS. 5 and 6.
Figure 6:
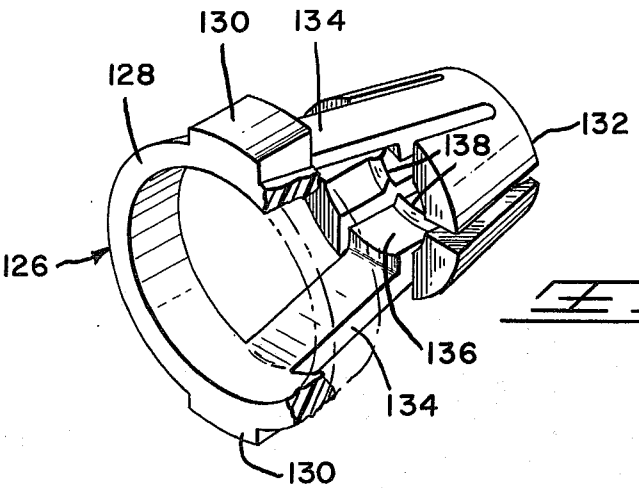
FIG. 6 is a perspective view of an alternate cable strain relief member, having parts broken away for the purpose of clarity.

FIGS. 5, 6 and 7 illustrate alternatives to particular elements of the subject kit which are now described in detail. A connector housing 98 finds application when a shrouded pin to socket type connection is required to mate pins of a socket connector of a first electrical device to receptacle contacts of a plug in a second electrical device. The housing 98 has a forward annular skirt or flange portion 100, an outwardly directed radial flange 102, a detent groove 104 divided by an integrally molded barrier 106, and a plurality of cavities 108 extending from a mating face 110 within the skirt portion 100, to a rearward face 112. Each cavity has an inwardly directed annular flange 114 intermediate faces 110 and 112 and forming shoulders 116, 118 on opposite sides thereof. A pin embodiment of second terminal member 18 is shown in FIGS. 4, 5 and 7 to include a cylindrical rearward portion 56, pin shaped mating portion 58, an annular grooved intermediate portion 62, and resilient latching lances 60. FIGS. 5 and 7 further illustrate an alternative coupling collar 120 having an inwardly directed bayonet projection 122 adjacent the front edge of the collar, and a generally annular lip 124 projecting inwardly from the rear edge of said collar.

FIG. 6 shows an alternative strain relief 126 comprising a forward resilient ring 128 having a pair of guide extensions 130 and a rearward slotted barrel portion 132. The ring 128 and barrel portion 132 are integrally connected together by a pair of resilient side ribs 134. The barrel portion 132 has a truncated conical outer profile with an axial bore 136 therethrough. At least one internally molded tooth forming ridge 138 extends around the bore 136.

Assembly of a connector kit having the hereinabove described alternative elements, best seen in FIGS. 5 and 7, proceeds generally as herein set forth for the connector kit 10 of FIG. 1. In particular, the contact housing 98 accepts the rearward mounting of coupling collar 120 therearound, with the annular lip portion 124 contacting the flange 102 to prohibit the forward removal of the collar. The pin shaped second terminals 18 are inserted into the cavities 108 from the rearward end thereof until the outwardly biased latching lances 60 and the annular groove 62 engage shoulders 116, 118, respectively, to prevent removal of the terminal from the cavity. Referring to FIGS. 6 and 7, the strain relief 126 has the cable 24 extended therethrough subsequent to the extension of the cable through the cable guard member 12. The guiding ears 130 are aligned within the guide channels 44 and the strain relief 126 subsequently inserted into the cable guard 12. The constricting nature of the inner sidewalls of rings 38 toward the rearward end 36 of the cable guard 12 collapse the slotted resilient barrel portion 132 around the cable 24 as the strain relief is inserted into the cable guard, and further insertion of the strain relief forces the ridge 138 to bite into the insulative covering of the cable. The cable is thereby fixedly held within the cable guard 12 and rearward removal precluded since rearward movement of the strain relief 126 is restricted by the rings 38. The first terminal members 16, which are affixed to the ends of the conductors 26 of cable 24 are inserted into mating engagement with the cylindrical portions 56 of the pin second terminals 18 in the fashion hereinabove set forth and suggested in FIG. 4. The housing 98 is then inserted into the cable guard 12, after appropriate alignment, and subsequent relative rotation therebetween locks the housing 98 within the cable guard 12. The completely assembled connector can be mated to a connector in a second electrical device having receptacle terminals configured and structured to accept the mating pin portions 58 of the terminals 18.

It can readily be appreciated that the practice of the subject invention requires that the cavity/terminal configuration of the connector housing mirror the cavity/terminal configuration of the second device, so selection of the correct housing is important. FIGS. 8, 9 and 10, illustrate mating end elevations of three connector housings 140, 142, 144, respectively, having different cavity/terminal configurations. The user would select the housing to match the terminal configuration of a specific electrical device. Because the first terminals 16 can be repeatedly mated to and unmated from, the cylindrical rear portion of second terminals 18 having either a socket mating end 58, FIG. 1, or a pin mating end 58, FIG. 4, connector housings containing either of these types of second terminals 18 can be interchangeably used to facilitate the use of one remote control device with a plurality of second electrical devices having sockets of differing configurations.

FIG. 11 shows how the first terminals 16 can be commoned by engaging the crimp barrel 54 of first terminal 16 in the cylinder 50′ of terminal 16′. The slot 52′ has sufficient width to pass conductor 26. At least slotted cylinder 50 can be received in cylinder 56 of the second terminal 18. However, both slotted cylinders 50 and 50′ could be force fitted into cylinder 56 to assure adequate forces compressing the slotted cylinders to assure good electrical and mechanical connection.

The present invention, as well as the individual components thereof, may be subject to many modifications and changes without departing from the spirt or essential characteristics thereof. The present embodiments are therefor to be considered in all respects as illustrative and not restrictive of the scope of the invention.

What is claimed is:

1. An electrical connector assembly for terminating a cable comprising a plurality of conductors encased within an outer cable sheath, said assembly comprising:

a like plurality of first terminals each having a rearward portion affixed to a forward end of one of said conductors, and a generally cylindrical forward portion having a longitudinal slot extending the length thereof dimensioned to receive a rearward portion of another said first terminal laterally therethrough;

a plurality of dual-ended second terminals each having a hollow cylindrical rearward portion adapted to receive therein the forward portion at least one of said first terminals, and having integral forward mating means, a housing member having a plurality of terminal receiving cavities extending therethrough from a forward end to a rearward end, each of said cavities being adapted to receive one of said second terminals therein and said housing member having integral retention means engaging said second terminals.

2. The assembly as set forth in claim 1, wherein said plurality of first terminals are greater in number than said plurality of said second terminals.

3. The assembly as set forth in claim 1, wherein said plurality of said second terminals are equal in number to said plurality of terminal receiving cavities.

4. The assembly as set forth in claim 1, further comprising a coupling collar member having means peripherally engaging said housing member.

5. The assembly as set forth in claim 1, forward ends of said conductors being adapted to project forward free of said cable sheath, and said assembly further comprising;

a strain relief member secured to said cable sheath proximate said forward cable end, and having oppositely disposed and outwardly directed projection means;

an elongated cable guard member having a longitudinal bore receiving said cable of conductors therethrough, said cable guard member engageably receiving said strain relief member and said rearward end of said housing member into a forward end of said longitudinal bore, and said guard member having rearward means for reinforcing said cable from mechanical overflexing.

6. A connector assembly as set for in claim 5, wherein said strain relief member comprises:

a metallic body adapted for clamping engagement to said cable sheath.

7. A kit for an electrical connector assembly for electrically connecting one end of a plurality of conductors in a cable to a first electrical device having a plurality of terminal members arranged thereon in a mating connector, the opposite end of said plurality of conductors of said cable being connected to a remote second electrical device, the kit comprising:

a plurality of first terminals, each having a rearward portion adapted to be affixed to said one of said conductors and a cylindrical forward portion having a longitudinal slot extending the length thereof dimensioned to facilitate the reception of a rearward portion of another said first terminals laterally therethrough so that electrically commoning and disengageable contact may be established between two of said first terminals;

a plurality of dual ended second terminals having a hollow cylindrical rearward portion adapted to receive therein the forward portion of at least one of said first terminals, a forward portion mateable with terminal members of said first electrical device, and retaining means on said second terminals;

at least one housing member, said one housing member having a plurality of terminal receiving cavities extending therethrough from a forward mating face to a rearward face, each of said cavities being dimensioned to closely receive one of said second terminals therein and having means adapted to engage said retaining means of said terminal to secure said terminal within the cavity, said cavities being presented at said forward face in a configuration mirroring said terminal configuration of said first device, said housing member further having a rearward portion with means defining a locking groove therein, and an integral, outwardly directed flange extending around said housing intermediate the ends thereof;

a coupling collar member having an internally directed annular lip portion and fastening means engageable with said connector of said first electrical device, said collar member being mountable over said rearward portion of said housing member with said lip portion abutting said flange to prevent forward removal of said collar from said housing;

a strain relief member secured around said cable of said conductors proximate said one end, said strain relief member having outwardly directed guide projections;

an elongated cable guard member having a bore extending therethrough from a forward end to a rearward end, said cable of conductors being extended therethrough out said forward end; said cable guard member having guiding grooves longitudinally extending from said forward end along walls of said bore, the grooves being dimensioned to receive said guide projections of said strain relief member therein and therealong; so that said strain relief is thereby received into said bore to the extent of said guiding grooves; said cable guard member having a profiled configuration and dimension at said forward end to closely receive said rearward portion of said housing member therein, integral detent means for engaging said locking groove means of said housing to detachably secure said housing therein, and a rearward gripping portion for reinforcing said cable from mechanical overflexing.

8. A kit for an electrical connector assembly for electrically connecting one end of a plurality of conductors in a cable to a first electrical device, the opposite end of said plurality of conductors being connected to a remote second electrical device, the kit comprising:

a plurality of first terminals, each one having one end affixed to one of said conductors and an opposite end defining a cylinder with a longitudinal slot extending the length thereof, said slot being dimensioned to facilitate the reception of a rearward portion of another said first terminal laterally therethrough so that electrically commoning and disengageable contact may be established between two of said first terminals;

a plurality of dual-ended second terminals having a cylindrical rearward portion adapted to receive therein said opposite end of at least one of said first terminals and having a forward portion mateable with a further terminal; and at least one housing member, said one housing member having a plurality of contact receiving cavities extending therethrough from a forward mating face to a rearward face, each of said cavities being dimensioned to closely receive one of said second terminals therein, whereby said second terminals are loaded into said cavities and said first terminals inserted into said cavities in mating engagement with the rearward portions of said second terminals.

9. A kit as set forth in claim 8 wherein each said second terminal further comprises retaining means, and each said cavity in said housing member has means adapted to engage said retaining means of a respective second terminal, to secure said second terminal with the cavity.

10. A kit as set forth in claim 8, wherein said first device has a plurality of terminal members arranged thereon in a set configuration, said cavities of said connector housing being presented at said forward face in a configuration mirroring the socket configuration of said first device, and each said forward portion of each said second terminal being mateable with a respective contact member in said first device.

11. A kit as set forth in claim 8 wherein said cylinder of said first terminal is dimensioned to receive a conductor engaging end of a first terminal whereby conductors of said cable are commoned by interengagement of at least two of said first terminals.

* * * * *